US012753745B2

(12) United States Patent
DeYoung

(10) Patent No.: US 12,753,745 B2
(45) Date of Patent: Oct. 6, 2026

(54) ROTATING RECIPROCATING PISTON PUMP WITH A BARREL CAM

(71) Applicant: HTI Technology and Industries, Inc., La Vergne, TN (US)

(72) Inventor: Roger L DeYoung, Franklin, TN (US)

(73) Assignee: HTI Technology and Industries, Inc., La Vergne, TN (US)

( * ) Notice: Subject to any disclaimer, the term of this patent is extended or adjusted under 35 U.S.C. 154(b) by 171 days.

(21) Appl. No.: 18/453,381

(22) Filed: Aug. 22, 2023

(65) Prior Publication Data

US 2024/0068457 A1 Feb. 29, 2024

Related U.S. Application Data

(60) Provisional application No. 63/373,252, filed on Aug. 23, 2022.

(51) Int. Cl.

| | |
|---|---|
| ***F04B 7/06*** | (2006.01) |
| ***F04B 7/00*** | (2006.01) |
| ***F04B 9/04*** | (2006.01) |
| ***F04B 53/14*** | (2006.01) |

(52) U.S. Cl.

CPC ..... *F04B 7/06* (2013.01); *F04B 9/042* (2013.01); *F04B 9/047* (2013.01); *F04B 53/143* (2013.01); *F04B 7/0061* (2013.01)

(58) Field of Classification Search

CPC .. F04B 7/06; F04B 9/042; F04B 9/047; F04B 53/143; F04B 7/0061; F04B 13/00

See application file for complete search history.

(56) References Cited

U.S. PATENT DOCUMENTS

| | | | | |
|---|---|---|---|---|
| 3,168,872 A * | 2/1965 | Pinkerton | F04B 7/06 417/500 |
| 5,472,320 A * | 12/1995 | Weisbrodt | F04B 7/06 417/415 |
| 2002/0064466 A1* | 5/2002 | Schutz | F04B 49/12 417/397 |
| 2021/0353853 A1* | 11/2021 | Agard | A61M 5/14216 |

FOREIGN PATENT DOCUMENTS

| | | | |
|---|---|---|---|
| DE | 4134882 A1 * | 12/1992 | F04B 7/06 |

OTHER PUBLICATIONS

DE4134882A1 translation (Year: 2025).*

* cited by examiner

*Primary Examiner* — David N Brandt

(74) *Attorney, Agent, or Firm* — Emerson, Thomson & Bennett, LLC; Roger D. Emerson; Peter R. Detorre

(57) ABSTRACT

Provided is a metering pump. The metering pump includes a motor and a motor shaft and a pump housing having an inlet port and an outlet port. Encased within the pump housing and engaged to the motor shaft is a piston. The motor shaft imparts rotational movement upon the piston. The metering pump further includes two barrel cam halves engaged to the piston. Between the two barrel cam halves is a cam follower pin which in combination with the two barrel cam halves allows the piston to move in a reciprocating manner upon rotation of the motor shaft. Thus, the piston is capable of moving in both a rotational and reciprocating manner along the same axis.

18 Claims, 10 Drawing Sheets

Prior Art of RRP Pump

Prior Art of RRP Pump

Present Art of RRP Pump

Present Art of RRP Pump

ROTATING RECIPROCATING PISTON PUMP WITH A BARREL CAM

TECHNICAL FIELD

Provided is a pump and pump assembly. The pump and pump assembly is capable of being used in metering applications and includes a rotating and reciprocating piston. Also provided is a rotating reciprocating piston for use in pumps and other similar devices.

BACKGROUND

Metering pumps are used in applications that require accurate volumetric dispensing of fluids. Such applications include laboratories, industrial equipment that requires mixing of fluids, and detergent dispensing such as laundry equipment and car washing equipment. Multiple pump technologies exist for metering pump applications. One pump technology, rotating reciprocating piston pumps (RRP Pumps), first developed and patented in 1965, (U.S. Pat. No. 3,168,872), is known to be a very accurate pump technology; and is typically a preferred technology for laboratory metering requirements. Since first developed, RPP Pump technology has not significantly evolved, and these pumps are significantly more expensive than other pump technologies such as peristaltic pumps. Consequently, RPP Pump technology is not considered for applications where cost is a driving factor. To that end, HTI has developed an economical version of this technology with novel enhancements. The primary enhancement is how the rotating and reciprocating piston is driven by its motor. Current rotating reciprocating piston pump technology incorporates a feature that pivots the centerline of the pump piston with respect to the centerline of the motor shaft, thus putting the two axes at an angle to each other. The result at the point of coupling the piston to the motor shaft is an elliptical orbit. This elliptical orbit creates a reciprocal motion on the piston as it rotates. Volumetric flow can be increased or decreased by increasing or decreasing the axis angle. This method of driving the rotating and reciprocating piston has two known drawbacks—one, the mechanical coupling is expensive and two, the piston's linear travel is continuous, which creates negative and positive pressures, within the cylinder, at both ends of the stroke. These pressures are momentarily trapped until the pressures can escape through a pump port, thus causing inefficiency and creating unwanted fluid pulses when the cylinder ports open and close.

SUMMARY

Provided is a metering pump assembly. The metering pump assembly includes the following components: a motor, wherein the motor comprises a motor shaft positioned along an axis which moves in a rotational manner when energized by the motor; a pump housing, wherein the pump housing comprises a trailing end and a closed leading end; a piston positioned within the pump housing, wherein the piston comprises a trailing end and a leading end, wherein the trailing end of the piston is connected to the motor shaft and the motor along the axis of the motor shaft, wherein a space is provided between the leading end of the piston and the closed leading end of the pump housing, wherein the space fluctuates in size depending on the position of the piston within the pump housing; an inlet port, wherein the inlet port extends through the pump housing; an outlet port, wherein the outlet port extends through the pump housing; a first barrel cam half; a second barrel cam half; a cam follower pin, wherein the cam follower pin is positioned within a peripheral slot between the first barrel cam half and the second barrel cam half, wherein the first barrel cam half and the second barrel cam half are connected to the piston, wherein rotational movement of the motor shaft directly imparts rotational movement upon the piston and indirectly imparts reciprocal movement of the piston through movement of the cam follower pin within the peripheral slot between the first barrel cam half and the second barrel cam half, and wherein the piston remains aligned with the axis of the motor shaft during rotational and reciprocal movement of the piston without having to angle the piston with respect to the motor shaft to generate reciprocal movement of the piston within the pump housing.

Also provided is a method of manufacturing a metering pump assembly. The method includes the following steps: providing a motor; providing a motor shaft and connecting the motor shaft to the motor, wherein the motor is capable of energizing the motor shaft to impart rotational movement upon the motor shaft; providing a pump housing and engaging the pump housing to the motor and motor shaft; providing an inlet port and an outlet port which passes through the pump housing; providing a piston and positioning the piston within the pump housing; providing a first barrel cam half and a second barrel cam half and installing the first barrel cam half and the second barrel cam half to an engagement position with respect to the piston; providing a cam follower pin and installing the cam follower pin within the peripheral slot between the first barrel cam half and the second barrel cam half.

Also provided is a method of operating a metering pump assembly. The method includes the following steps: positioning a piston in a first position wherein a "D" Shaped cutout within a piston is oriented in a position corresponding to the first position of the piston within a cylindrical housing, wherein access to an inlet port and to an outlet port within a pump housing is closed; positioning the piston in a second position, wherein a second position is obtained by a motor shaft causing the piston to rotate and move toward a trailing end of the cylindrical housing, thereby allowing the first piston shut off edge to pass over the inlet port to open access to the inlet port, allowing fluid to enter the inlet port, pass through the opening in the "D" Shaped cutout and enter an internal piston cavity provided by internal cutout within the body of the piston and allowing the fluid to pass from the internal piston cavity through the opening in a leading bearing hoop at a leading end of the piston and into the space provided between the leading end of the piston and a closed leading end of the pump housing; positioning the piston in a third position, wherein the third position is obtained by the motor shaft causing the piston to rotate and move toward the trailing end of the pump housing, wherein the "D" Shaped cutout within the piston is oriented in a position corresponding to the third position of the piston within the cylindrical housing, wherein access to the inlet port and to the outlet port within a pump housing is closed wherein the fluid passes through the opening in the leading bearing hoop into the internal piston cavity provided by the internal cutout within the body of the piston; positioning the piston in a fourth position, wherein the "D" Shaped cutout is oriented in a position corresponding to the fourth position of the piston within the pump housing, wherein access to the inlet port is closed and access to the outlet port is open.

DETAILED DESCRIPTION

The present disclosure is directed to a pump, also referred to as a pump assembly. According to certain aspects of the present teaching, the disclosure is directed to a metering pump which is a pump that is not necessarily designed to pump as much fluid as possible, but rather, is designed to dispense accurate volumetric amounts to other applications such as desired fluid streams and vessels. The pump assembly includes a rotating and reciprocating piston within a cylinder that has two port holes, an inlet port hole and an outlet port hole, by which fluids are managed. The piston includes a flat cut across a portion of its diameter creating a "D-shaped" cross section. The piston is connected to a motor that rotates the piston with its "D-shaped" cross section, which opens and closes ports on each side of the cylinder. As the piston rotates, two barrel cam halves, positioned around and connected to the piston, guide a cam follower pin, connected to a coupler, through a peripheral slot between the two barrel cam halves. This generates a reciprocating motion on the piston's movement concurrent with the piston's rotational motion. According to certain aspects of the present teaching, the piston rotates 180° on the intake stroke and 180° on the output stroke. At each end of each stroke, the "D-shaped" cross section blocks and seals both ports simultaneously. The pump assembly includes several features that are unique and not available or known in pump assemblies of the prior art. First, a barrel cam feature provides a rotational dwell of the piston for several degrees before and after the closing and opening of both ports. This rotational dwell eliminates inefficient and unwanted negative and positive pressures at both ends of the stroke and unwanted fluid pulses when the cylinder ports open and close. Second, the axis of the piston and the motor shaft remain aligned, thus reducing complexity and cost. In addition, the piston includes a cylindrical hoop at its leading end surface and an opening which forms a fluid passageway that is positioned inside the hoop. The hoop provides cylindrical bearing surface at the leading edge in conjunction with the cylindrical bearing surface at the trailing edge of the piston, thus eliminating the cantilevered configuration of other rotating reciprocating piston pumps (RRP) pump pistons. The piston hoop configuration also reduces the overall length of the piston. This is explained in greater detail below with reference to FIGS. 13A through 13D. Lastly, volumetric flow may be adjusted in pump assembly by increasing or decreasing the motor shaft speed through currently available motor control technology.

Figure 1:
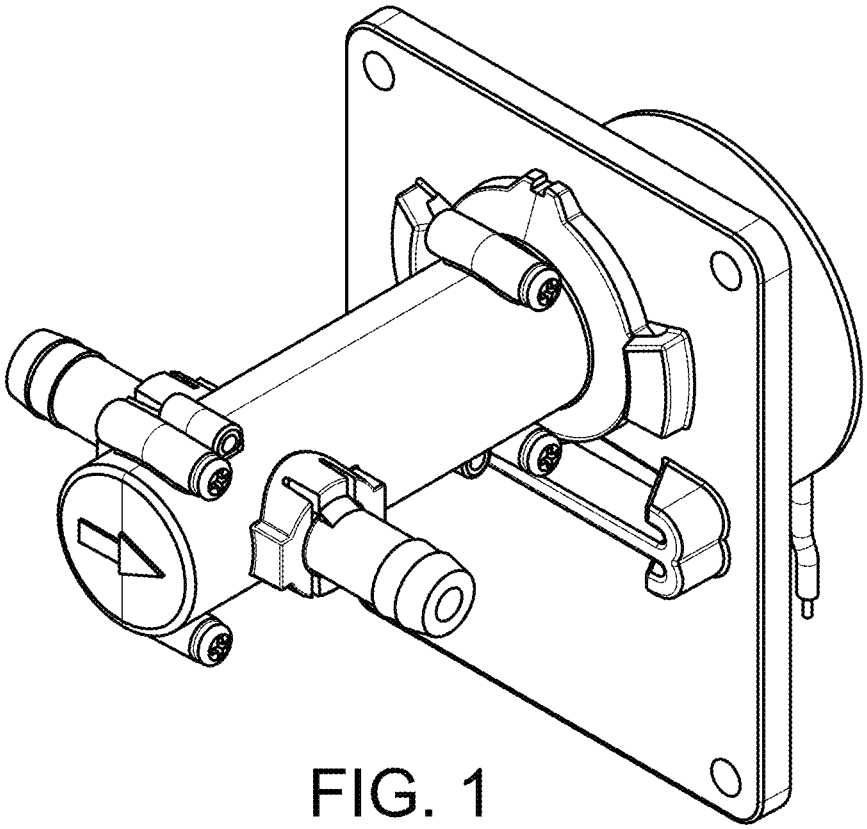
FIG. 1 shows a perspective of a complete pump assembly.
Figure 2:
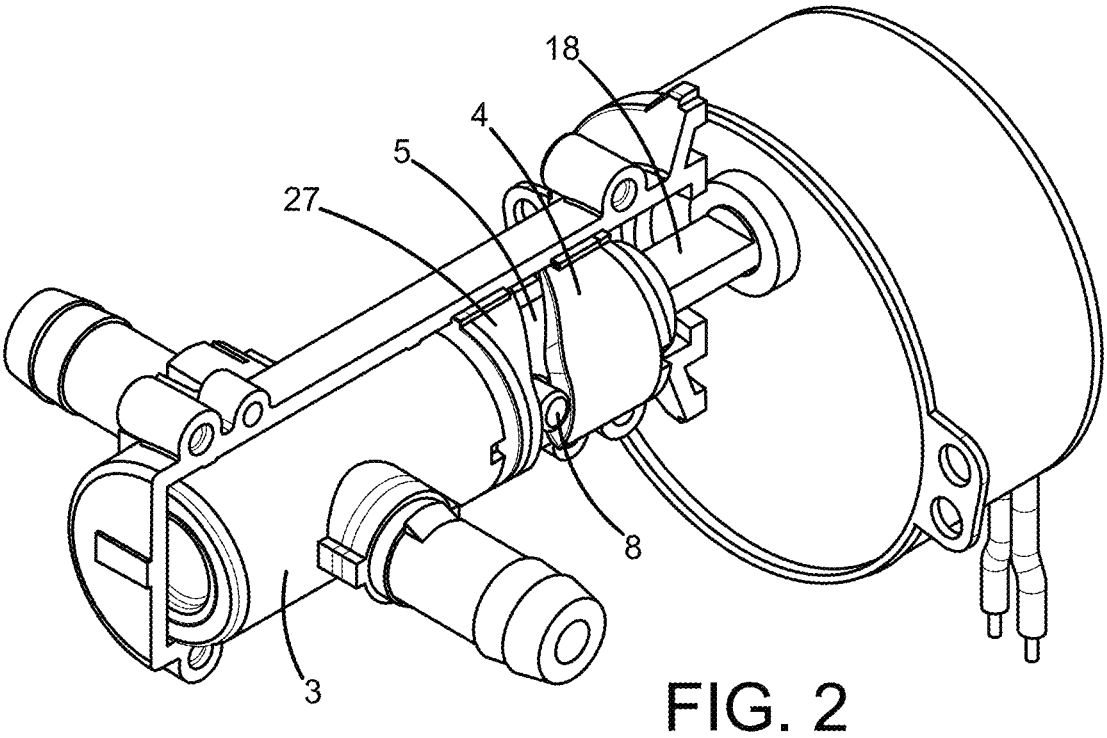
FIG. 2 shows a cut-away perspective of a pump assembly.
Figure 3:
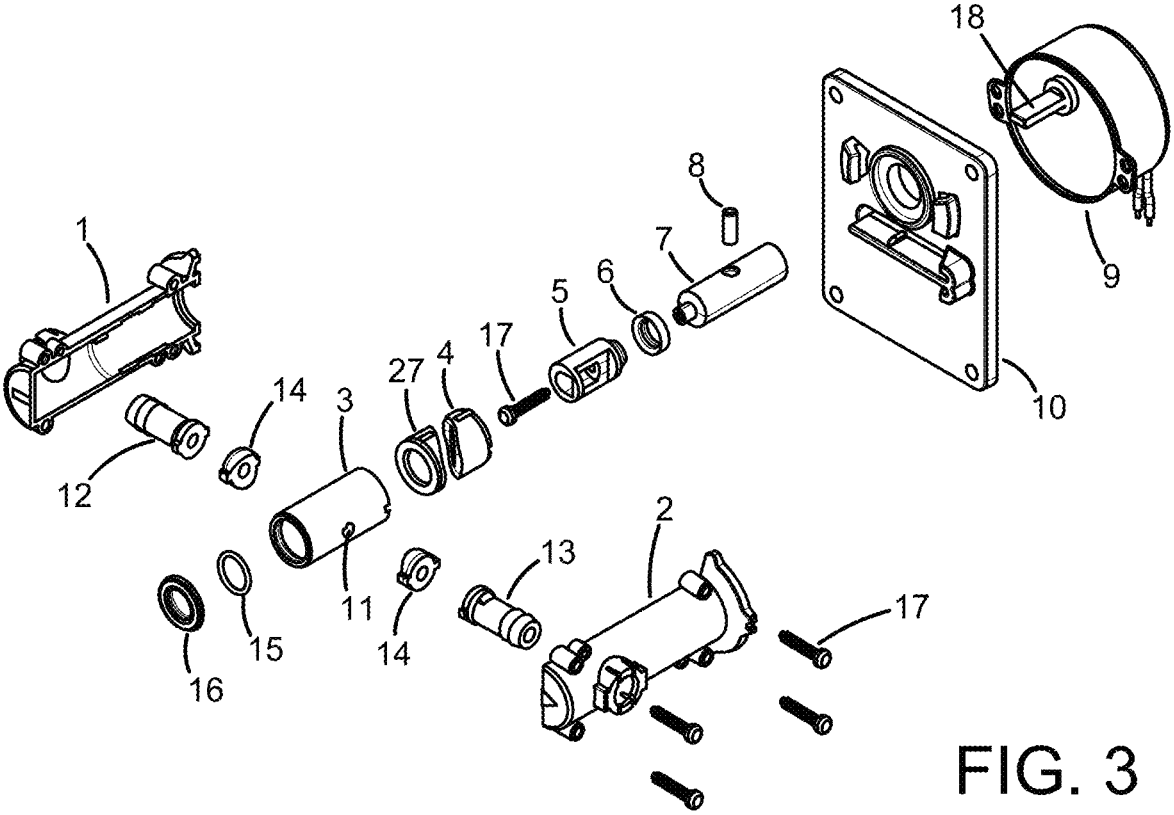
FIG. 3 shows an exploded view of the complete pump assembly.

An exemplary pump assembly is provided for in FIGS. 1 through 3. FIG. 1 illustrates an exemplary embodiment of a pump assembly in its completed or assembled form. The pump assembly in FIG. 1 includes a motor (9), an assembled pump housing (also referred to as a cylinder housing), a mounting plate (10) (also referred to as a support plate), connecting the motor (9) to the cylinder housing, an inlet port housing (12) (also referencing the inlet port and the inlet port fitting) and an outlet port housing (13) (also referencing the outlet port and the outlet port fitting). FIG. 2 illustrates a cut-away view of the pump assembly (100) of FIG. 1. As illustrated within FIG. 2, the piston (5) is positioned within pump cylinder (3) which is positioned within the cylinder housing. The piston (5) is connected to the motor 9 through a motor shaft (18) which provides rotational movement to the piston (5). Also engaged to the piston are two barrel cam halves, also referred to as a first barrel cam half (4) and a second barrel cam half (27). According to certain aspects of the present teaching, the two barrel cam halves are positioned over a coupler (7) which is engaged to the piston (5). The two barrel cam halves are positioned between the coupler (7) and the pump cylinder (3). The barrel cam halves provide a space therebetween forming a guide for a cam follower pin (8) to travel. The cam follower pin (8) extends outward from the piston (5).

FIG. 3 illustrates an exploded view of the completed pump assembly of FIGS. 1 and 2. According to FIG. 3, a motor shaft (18) extends outward from a motor (9) which imparts rotational movement on the motor shaft (18) when in operation. The motor shaft (18) fits within and passes through an opening on a pump assembly mounting plate (10). The motor shaft includes a trailing end (also referred to as a proximal or first end) connected to the motor (9) and a leading end (also referred to as a distal or second end which passes through the opening in the mounting plate (10) and engages a coupler (7). The coupler (7) functions to connect the piston (5) to the motor shaft and includes a trailing end (also referred to as a proximal or first end) connected to the motor shaft (18) and a leading end (also referred to as a proximal or second end) connected to the piston (5). The longitudinal surface of the coupler (7) includes an opening allowing for insertion of a cam follower pin (8). The piston (5) includes a trailing end (also referred to as a proximal or first end) connected to the coupler (7) and a leading end (also referred to as a proximal or second end). According to certain aspects of the present teaching, the coupler (7) also includes a protrusion at its leading end which may be designed to fit a corresponding recessed opening within the piston (5), thereby connecting the piston (5) to the coupler (7). According to further aspects of the present teaching, a screw (17) is provided which may be passed through the leading end of the piston (5) and subsequently passed through an opening at the trailing end of the piston (5) and into an opening at the leading end of the coupler (7) (for example, into an opening within the protrusion at the leading end of the coupler). Tightening the screw (17) secured at the trailing end of the piston (5) into the opening of the coupler (7) allows for secure engagement of the piston (5) to the coupler (7). According to further aspects of the present teaching, a piston seal (6) may be positioned between the trailing end of the piston (5) and the leading end of the coupler (7) to seal the radial gap between the piston (5) and the internal surface of the cylinder (3), thus preventing fluid leakage onto the connecting portion of the piston (5) and coupler (7).

In further reference to FIGS. 2 and 3, a first barrel cam half (4) and a second barrel cam half 27 are positioned over and around the coupler with the first barrel cam half (4) positioned towards the trailing end of the coupler and the second barrel cam half 27 positioned towards the leading end of the coupler (7). The first and second barrel cam halves (4) and (27) are fitted in such a manner over the coupler (7) so as to provide a space or gap, hereinafter referred to as a slot or peripheral slot, between the first and second barrel cam halves (4) and (27). The cam follower pin (8) extending outward from the longitudinal surface of the coupler (7) fits within the slot between the first and second barrel cam halves (4) and (27) and is designed to travel along a length of the slot between the first and second barrel cam halves (4) and (27) as the piston rotates with the rotation of the motor shaft. The slot between the first and second barrel cam halves (4) and (27) has a length which extends diagonally along a length of the coupler (7). This allows for reciprocal movement of the piston (5) as the motor shaft imparts rotational movement on the piston. The reciprocal movement is caused by the cam follower pin traveling along a length of the diagonal space or gap between the first and second barrel cam halves (4) and (27). Thus, the space or gap between the first and second barrel cam halves (4) and (27) functions as a guide for movement of the cam follower pin (8) which results in reciprocating movement of the piston within a cylinder in addition to rotating movement imparted on the piston (5) by the motor shaft (18). Accordingly, rotational movement of the piston (5) is concurrent with the piston's reciprocating movement. According to certain aspects of the present teaching, the piston is capable of rotating 180° on an intake stroke and 180° on an output stroke. However, the piston (5) is capable of rotating any number of degrees depending on the particular design of the pump assembly. The piston may further rotate in either a clockwise or counter-clockwise manner with an opposing rotation providing a reverse flow of fluid through the intake and outlet ports.

With further reference to FIGS. 2 and 3, the piston (5) fits within a cylinder (3), also referred to as a pump cylinder. The cylinder (3) is a component of the pump housing and in some embodiments may comprise the pump housing. The cylinder includes a trailing end (also referred to as a proximal or first end) and a leading end (also referred to as a distal or second end) which terminates at an end of a pump housing. According to further aspects of the present teaching, at least a portion of the leading end of the coupler (7) fits within the cylinder. The cylinder (3) includes a first cylinder port hole (11) and a second cylinder port hole (11) positioned along a circumference. According to certain aspects of the present teaching the first cylinder port hole and the second cylinder port hole are positioned opposite and in-line with one another along the circumference of the cylinder, for example 180° or approximately 180° apart. However, in other embodiments, the first cylinder port hole and the second cylinder port hole may be positioned at any point along the cylinder (3) and any distance from one another along the cylinder (3). An inlet port fitting (12) is fitted to the first cylinder port hole to engage or connect with the first cylinder port hole and an outlet port fitting (13) is fitted to the second cylinder port hole to engage or connect with the second cylinder port hole. According to certain aspects of the present teaching, a port seal (14) is fitted between the first cylinder port hole and the inlet port fitting (12) and between the second cylinder port hole and the outlet port fitting (12) to prevent the escape of fluid from the cylinder port holes and the inlet and outlet port fittings. The leading end of the cylinder is fitted with an o-ring (15) and an o-ring cap (16) which is positioned adjacent to the end of the pump housing.

According to certain aspects of the present teaching, the pump housing includes two half portions, referred to as a first pump housing (Pump Housing I) and a second pump housing (Pump Housing II). Pump Housing I and Pump Housing II fits over the entire pump assembly and includes a trailing end (also referred to as a proximal or first end) which engages the pump assembly at the mounting plate and a leading end (also referred to as a distal or second end) which terminates at the end of the pump assembly at a distance from the leading end of the pump cylinder. Pump Housing I and Pump Housing II are designed to fit together or engage one another and encapsulate the components of the pump assembly through a plurality of fasteners. An example of a fastener which may be used to engage Pump Housing I and Pump Housing II are screws (17) which are designed to fit within a plurality of fastener receiving apertures within Pump Housing I and Pump Housing II to threadably engage Pump Housing I to Pump Housing II. According to further aspects of the present teaching, the fastener receiving apertures of one of Pump Housing I and Pump Housing II includes threads while the fastener receiving apertures of one of Pump Housing I and Pump Housing II provides a supporting structural conduit for engagement. In other embodiments the fastener receiving apertures of Pump Housing I and Pump Housing II may alternate between providing the functional feature of threads and a structural conduit for engagement. In alternative embodiments, screws (17) used to engage Pump Housing I and Pump Housing II together are self-tapping screws and the fastener receiving apertures on Pump Housing I and/or Pump Housing II include a smooth receiving surface for the screws to engage.

Figure 4:
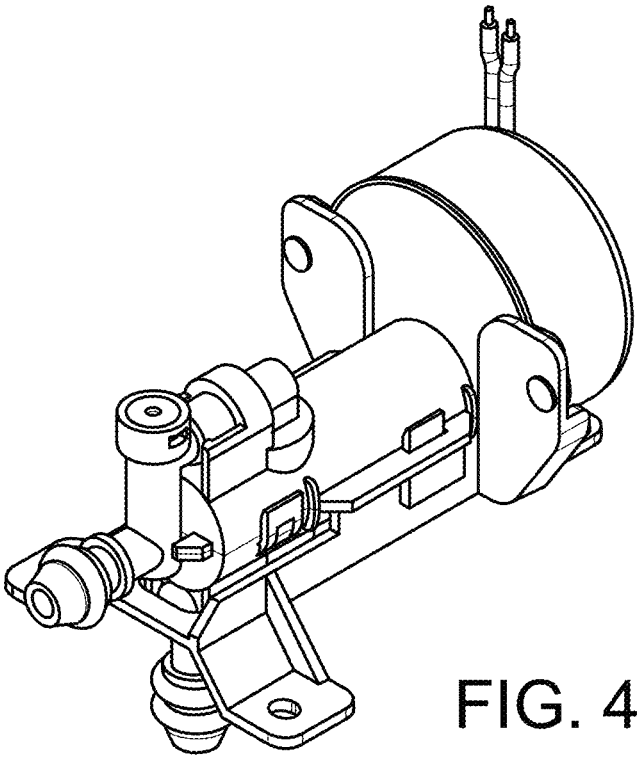
FIG. 4 shows an alternate configuration of the pump assembly with different port location and different mounting features.

FIG. 4 illustrates an alternate embodiment of a pump assembly. As shown in FIG. 4, the pump assembly includes a first mounting half plate and a second mounting half plate at the trailing end of the housing between the housing and the motor and a first mounting bracket and a second mounting bracket at the leading end of the housing. The inlet and outlet ports or port fittings are also positioned at 90° and perpendicular to one another with a first port fitting positioned at a housing face at the leading end of the housing and a second port fitting positioned at a bottom end of the housing at the leading end of the housing.

Figure 5:
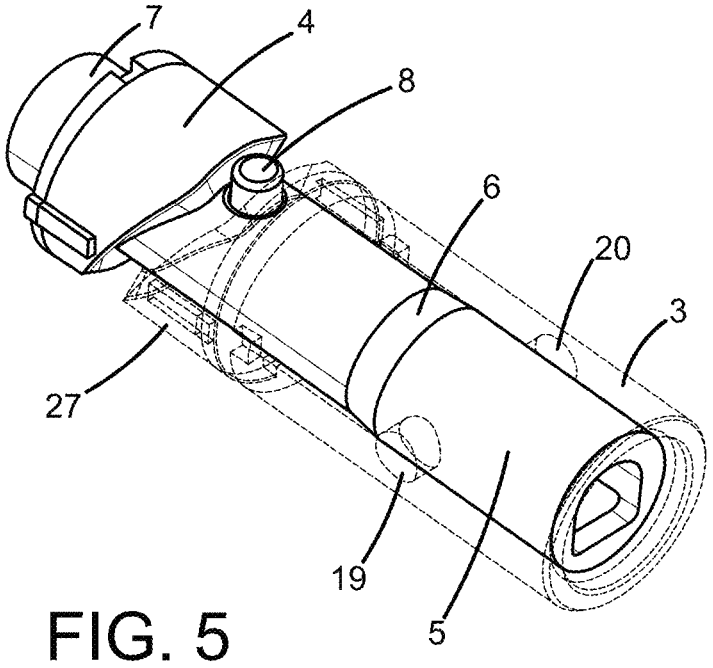
FIG. 5 shows an isometric view of the cylinder, piston, cam halves, cam follower pin, and coupler with the piston at the fully extended position with both cylinder ports shut-off by the piston. The piston shown in FIG. 5 is positioned in a first position.
Figure 6:
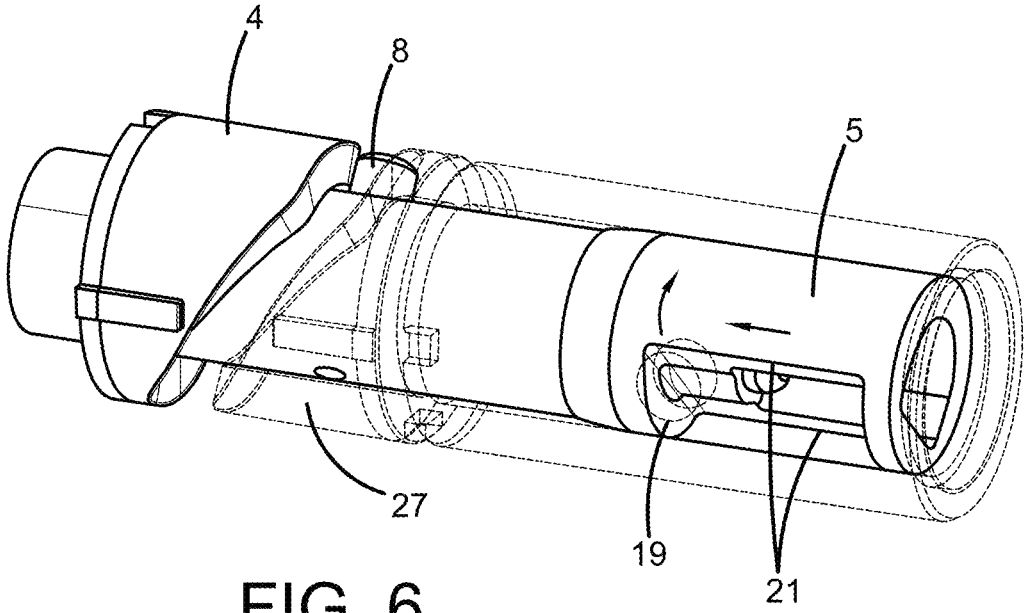
FIG. 6 shows an isometric view of the cylinder, piston, cam halves, cam follower pin, and coupler with the piston rotated and the inlet port opened for fluid intake. The piston shown in FIG. 6 is positioned in a second position.
Figure 7:
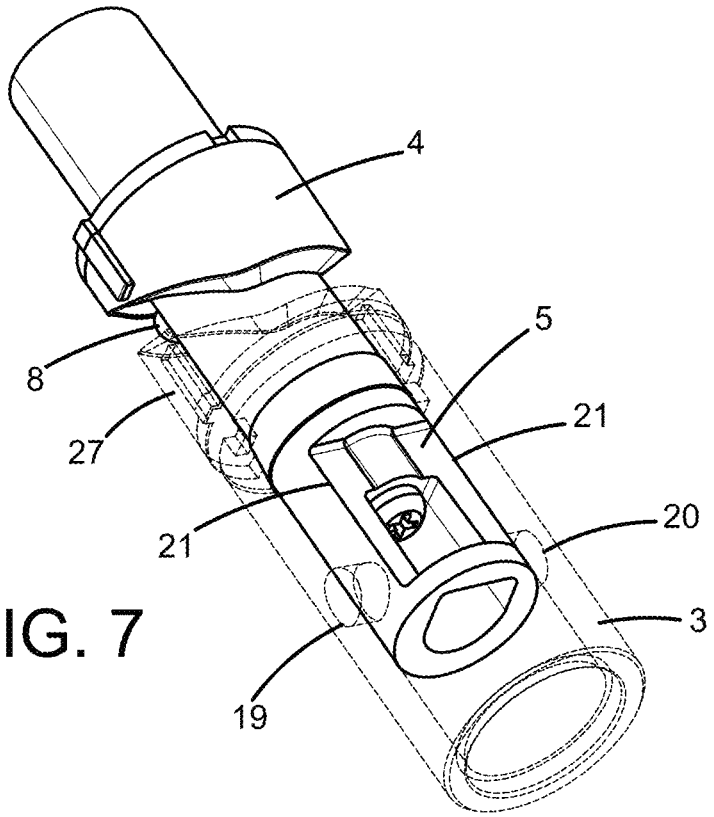
FIG. 7 shows an isometric view of the cylinder, piston, cam halves, cam follower pin, and coupler with the piston fully retracted and both cylinder ports shut-off by the piston. The piston shown in FIG. 7 is positioned in a third position.
Figure 8:
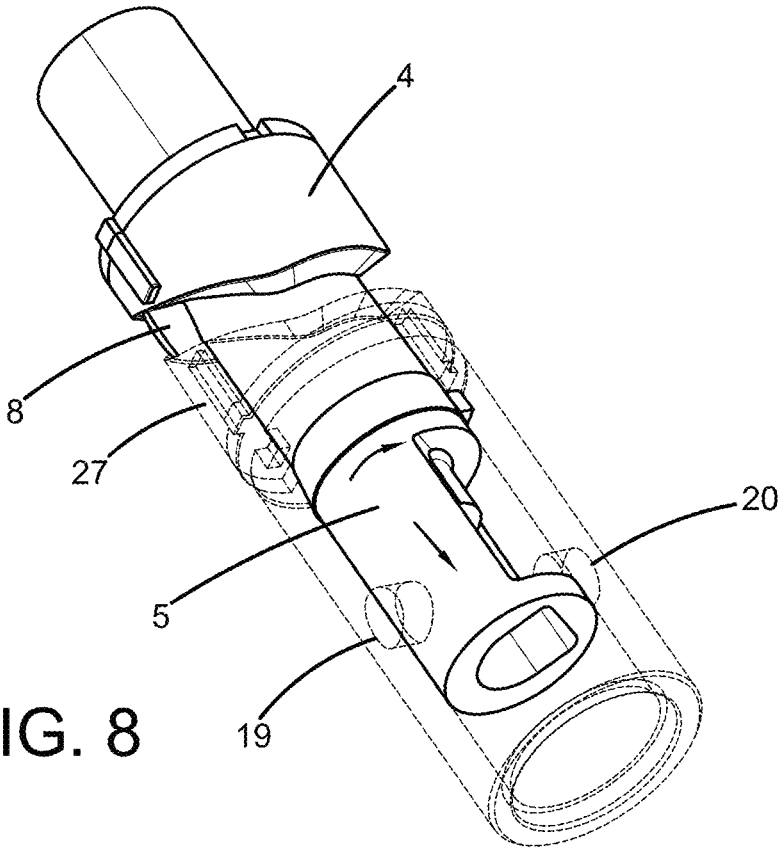
FIG. 8 shows an isometric view of the cylinder, piston, cam halves, cam follower pin, and coupler with the piston rotated and the outlet port opened for fluid dispensing. The piston shown in FIG. 8 is positioned in a fourth position.
Figure 12:
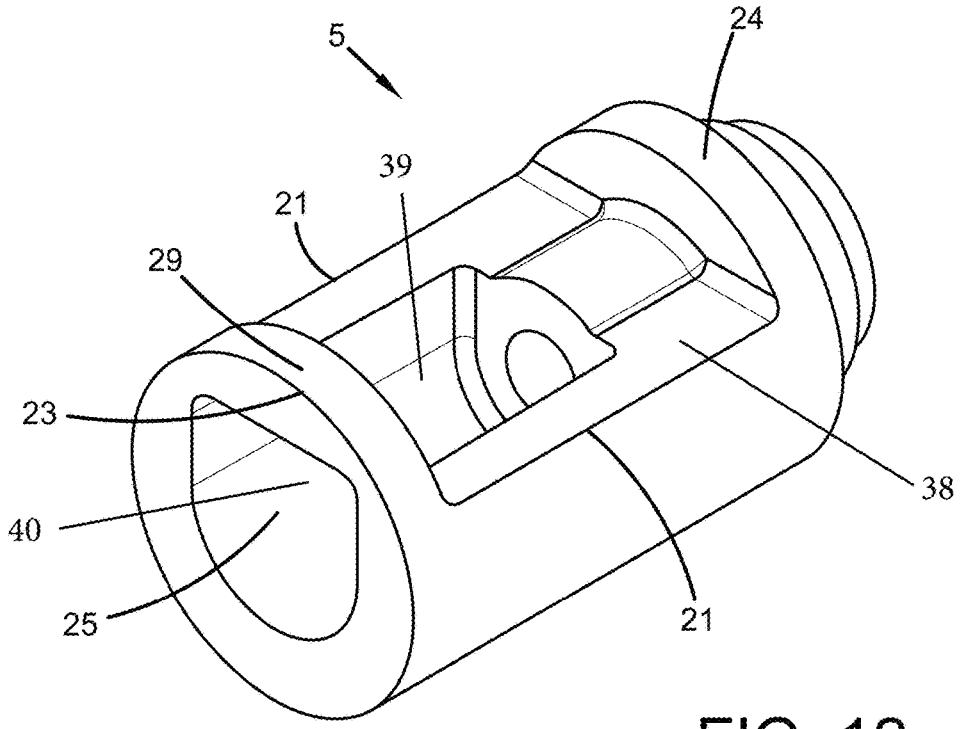
FIG. 12 is an isometric view of the piston showing the leading bearing hoop, trailing bearing surface, fluid passage, and piston shut-off edges.

The piston (5) as shown in FIG. 12, includes a "D" shaped cutout along its cylindrical surface of its body and an internal cutout within the body of the piston (5). Other features of the piston (5) discussed in greater detail below include a leading bearing hoop, a trailing bearing surface (24) and a fluid passage or fluid passageway (25) leading into the internal cutout within the body of the piston. The edges of the "D" shaped cut-out of the piston (5) represent what is referred to as a piston shut-off edge (21) with respect to the inlet port (19) and the outlet port (20). As the piston rotates within the cylinder (3), the piston shut-off edge (21) provides a point at which the inlet port (19) and outlet port (20) is either opened or closed. This depends on whether the piston shut-off edge (21) rotates over the inlet port (19) or outlet port (20) to expose the inlet port (19) or outlet port (20), or a portion of the inlet port (19) or outlet port (20) to an open space created by the "D" shaped cut-out within the piston (5), or rotates over the inlet port (19) or outlet port (20) to expose the inlet port (19) or outlet port (20) or a portion of the inlet port (19) or outlet port (20) to a part of the piston (5) that does not include the "D" shaped cut-out, thereby closing the inlet port (19) or outlet port (20). This is shown in FIGS. 5, 6, 7 and 8 which provide an isometric view of the piston and cylinder mechanism. FIG. 5 illustrates the piston (5) at a first fully extended position wherein both the inlet port (19) and the outlet port (20) of the cylinder (3) are closed by the piston (5). FIG. 6 illustrates the piston (5) in a second rotated and extended position within the cylinder (3) providing an opening for inlet port (19) to intake fluid. FIG. 7 illustrates the piston (5) in a third rotated and retracted position within the cylinder (3) wherein both the inlet port (19) and the outlet port (30) of the cylinder are closed by piston (5). FIG. 8 illustrates the piston (5) in a fourth rotated and retracted position within the cylinder (3) providing an opening for outlet port (20) to dispense fluid. It is noted that in the embodiments shown in FIGS. 5, 6, 7 and 8, opening and closing of the inlet port (19) and outlet port (20) depends depend solely on the rotational motion of the piston (5) regardless of whether the piston (5) is in a retracted state or in an extended state. However, it is also contemplated that in other embodiments, the inlet port (19) and the outlet port (20) may be opened or closed, in part in or whole, through the reciprocating motion of the piston, in addition to the rotational motion of the piston.

FIGS. 5, 6, 7 and 8 also illustrate the reciprocating movement of the piston (5) within the cylinder (3). This is accomplished through the coupler (7), barrel cam halves (4) and cam follower pin (8). As mentioned above with respect to FIG. 3, the cam follower pin (8) is attached to coupler (7). The coupler (7) is engaged to the motor shaft (18) at its trailing end and to the piston (5) at its leading end. A first barrel cam half (4) and a second barrel cam half (27) are positioned over the coupler, the first barrel cam half (4) being positioned over the trailing end of the coupler and the second barrel cam half 27 being positioned over the leading end of the coupler. Each of the barrel cam halves include a trailing edge facing towards the motor (9) and a leading edge facing towards the piston (5). A gap or space is provided between a leading edge of the first barrel cam half (4) and between the trailing edge of the second barrel cam half 27. The leading edge of the first barrel cam half (4) includes a first angled cam edge (30), a second angled cam edge (31) on a side parallel the first angled cam edge (30), a first cam flat section (22) (32), and a second cam flat section (33) on a side parallel the first barrel cam flat section (32). Likewise, the trailing edge of the second barrel cam half 27 includes a first angled cam edge (34), a second angled cam edge (35) on a side parallel the first angled cam edge (34), a first cam flat section (36), and a second cam flat section (37) on a side parallel the first cam flat section (36). The cam follower pin (8) protrudes outward from the coupler (7) and is positioned within this gap or space between the first barrel cam half (4) and the second barrel cam half 27. The gap or space between the first barrel cam half (4) and the second barrel cam half 27 may be referred to as a cam follower pin guide or slot. In operation, as the motor runs, it rotates the motor shaft (18) which in turn causes the coupler (7) to rotate and in turn causes the piston (5) to rotate. As the coupler (7) rotates, the cam follower pin (4) rotates along the same axis as the coupler. However, the cam follower guide between the first barrel cam half (4) and the second barrel cam half 27, more specifically, the leading edge of the first barrel cam half (4) and the trailing edge of the second barrel cam half 27, forces the cam follower pin to travel in an upward or downward direction along the cam follower guide (i.e., between the corresponding first angled edges of the first and second barrel cam halves or between the corresponding second angled edges of the first and second barrel cam halves. As the cam follower pin (8) is forced to travel within the cam follower pin guide between the first and second barrel cam halves, the piston is in turn caused to move in a reciprocating manner (i.e., in a back and forth motion) with the rotation of the rotary shaft. This allows the pump to provide both rotational motion and reciprocating motion to the piston along the same axis.

The metering pump may be designed so that the piston travels any distance within the cylinder. However, one limiting factor that may affect piston travel within the cylinder is the angle of the slope of the first and second barrel cams in relation to certain rotational hindrances of the piston. Such rotational hindrances include the piston's sliding friction factor and the fluid pressure acting upon the piston's pumping surface. Consequently, the angle of the slope of the first and second barrel cams must be properly designed and set to not be too steep to allow the cam follower pin to move through the cam follower pin guide or slot and overcome the sum of all rotational hindrances acting upon the piston. In other words, the maximum motor torque exerted upon the cam follower pin cannot be overcome by the steepness of the slope of the first and second barrel cams and the sum of the rotational hindrances exerted on the piston.

Figure 10:
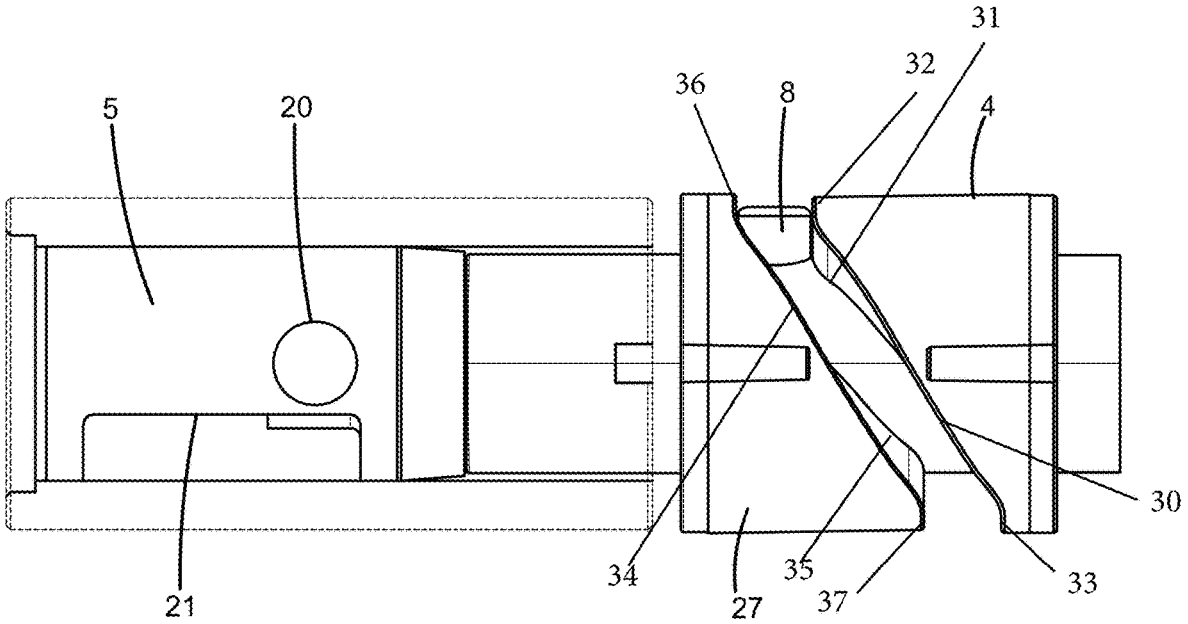
FIG. 10 is a side view of the cylinder, piston, cam halves, cam follower pin, and coupler with the piston at the fully extended position with both cylinder ports shut-off by the piston.

FIGS. 5 and 10 illustrate the piston (5) at or near top dead center (i.e., at or near its fully extended position). At this point, cam follower pin (8) is at a first position between cam flats (22) (32) and (36) between the first barrel cam half (4) and the second barrel cam half (27). This position of the cam follower pin (8) and the piston (5) can also be seen in FIG. 10 which illustrates a side view of the corresponding components. As seen in FIGS. 5 and 10, at this point, both the inlet port (19) and the outlet port (20) are closed by the position of the cylinder (5) and there is no volumetric space between the leading end of the piston and the inside face at the leading end of the cylinder. As the motor continues to rotate the cam follower pin (8) passed cam flats (32) and (36), the piston begins to rotate until piston shut-off edge passes the opening of the inlet port, thereby allowing the "D" shaped cut-out section to provide an opening for fluid to pass through inlet port (19). During this motion, the cam follower pin (5) begins moving down the angled space within the cam follower pin guide between the first barrel cam half (4) and the second barrel cam half (27). This causes the piston (5) to begin to retract or move downward within the cylinder. This movement of the cam follower pin (8) and the piston (5) is illustrated within FIG. 6. During this motion, fluid begins to enter cylinder through the inlet port (19) and into the space provided by the "D" shaped cutout, subsequently, into an internal space cutout within the body of the piston and subsequently, through a fluid passageway (25) at the leading end of the piston (5) and into a space formed between the leading end of the piston (5) and the closed leading end of the cylinder (3) as the piston (5) retracts within the cylinder (3). As the cam follower pin (8) continues to move across the angled portion of the cam follower pin guide, the piston shut-off edge continues to rotate passed the opening of the inlet port and the piston continues to retract, the opening provided by "D" shaped cutout of the piston, the internal space cutout within the body of the piston and the space formed between the leading end of the piston becomes more accessible, thereby allowing more fluid to enter the inlet port and into the volumetric space provided by the cutouts within the piston and the space between the leading end of the piston and the closed leading end of the cylinder.

Figure 11:
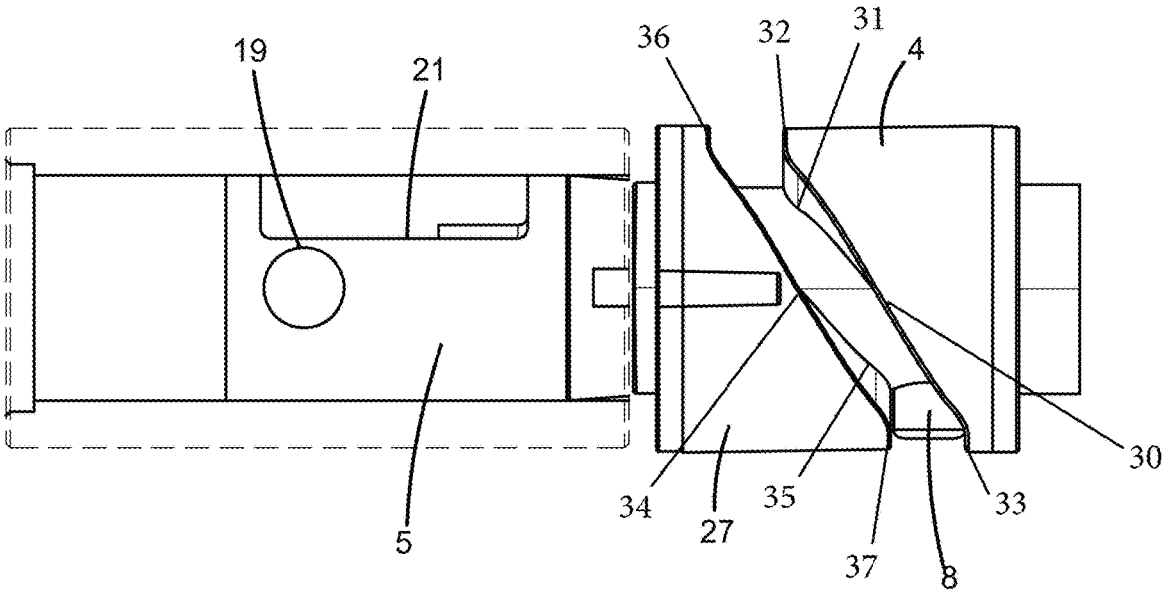
FIG. 11 is a side view of the cylinder, piston, cam halves, cam follower pin, and coupler with the piston at the fully retracted and both cylinder ports shut-off by the piston.

FIGS. 7 and 11 illustrate the piston (5) at or near bottom dead center (i.e., at or near its fully retracted position). At this point, cam follower pin (8) is at a second position between cam flats (33) and (37) between the first barrel cam half (4) and the second barrel cam half 27, on a side opposite the first position between barrel cam flats (33) and (37). This position of the cam follower pin (8) and the piston (5) can also be seen in FIG. 11 which illustrates a side view of the corresponding components. As seen in FIGS. 7 and 11, at this point, both the inlet port (19) and the outlet port (20) are again closed by the position of the cylinder (5). At this point, there is maximum or near maximum or substantially maximum volumetric space between the leading end of the piston and the inside face at the leading end of the cylinder. As the motor continues to rotate the cam follower pin (8) passed cam flats (33) and (37), the piston begins to rotate until piston shut-off edge passes the opening of the outlet port (20), thereby allowing the "D" shaped cut-out section to provide an opening for fluid to pass through outlet port (20) to be dispensed. During this motion, the cam follower pin (5) begins moving up the angled space within the cam follower pin guide between the first barrel cam half (4) and the second barrel cam half (27). This causes the piston (5) to begin to extend or move upward within the cylinder. This movement of the cam follower pin (8) and the piston (5) is illustrated within FIG. 8. During this motion, fluid begins to exit the cylinder (3) from the space between the leading end of the piston and the inside face at the leading end of the cylinder, through a fluid passageway opening (25) at the leading end of the piston and into the internal space cutout within the body of the piston, subsequently through the space of the "D" shaped cutout of the piston and through the outlet port (19) (20) and into the environment external to the cylinder (3). As the cam follower pin (8) continues to move across the angled portion of the cam follower pin guide, the piston shut-off edge continues to rotate passed the opening of the outlet port (20) and piston (5) continues to extend, the opening provided by "D" shaped cutout of the piston, the internal space cutout within the body of the piston and the space formed between the leading end of the piston becomes more accessible, thereby allowing more fluid to exit the outlet port (20) and into the environment external to the cylinder (3).

Figure 9:
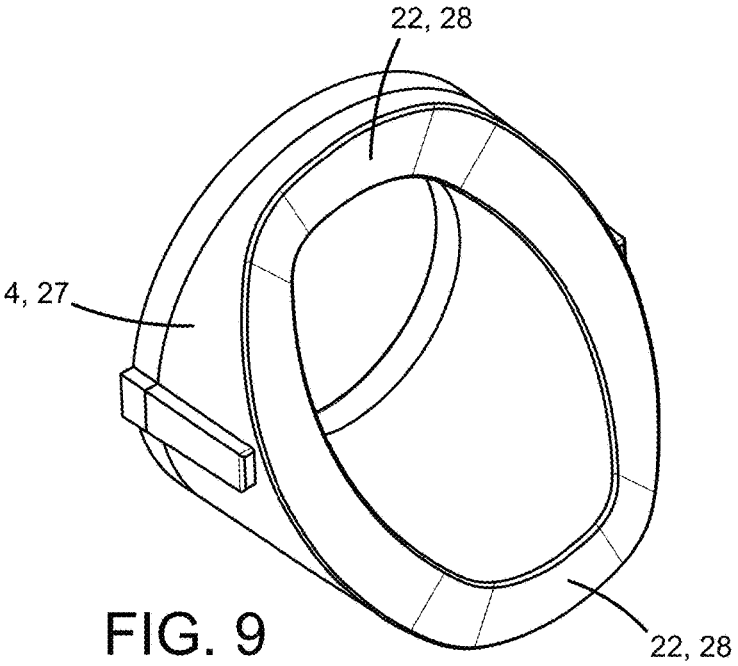
FIG. 9 shows one barrel cam half with two flat surfaces, one surface at each end of the cam travel to provide rotational dwell of the piston when the ports are closed simultaneously.

As mentioned above, the barrel cam feature provides a rotational dwell of the piston for several degrees before and after the closing and opening of both the intake port and the outlet port. These points of rotational dwell are provided by the cam flats present within the barrel cam halves. General cam flats (22) of the first barrel cam half and (28) of the second barrel cam half are illustrated within FIG. 9. FIG. 9 illustrates how each barrel cam half, (4) or (27), includes a first cam flat and a second cam flat that is parallel to and facing the same direction as the first cam flat. The cam flats represent a flattened section of the edge present within each barrel cam half. In this sense, the cam flats are not angled with respect to the rotational axis of the motor shaft as is the case with respect to the side edge portions of the cam. Instead, the cam flats are positioned orthogonal with respect to the rotational axis of the motor shaft in positions that are respectively both above and below the rotating coupler. Thus, as the cam follower pin (8) rotates within the cam follower pin guide between the two barrel cam halves, it reaches a dwell point at the top of the cam follower pin guide wherein the edges of the first and second barrel cams form a flattened section, i.e., a cam flat. This is illustrated within FIGS. 5 and 10 which shows the piston (5) at or near top dead center in its fully extended position. At this point, when both the inlet and outlet ports are closed, the motor shaft may rotate the coupler (7) and piston (5) for several degrees without the piston extending any further outward or beginning its retraction within the cylinder (3). In other words, the piston simply continues to rotate at this first point of rotational dwell without any reciprocating motion. Also, as the cam follower pin (8) continues to rotate within the cam follower pin guide between the two barrel cam halves, it reaches a dwell point at the bottom of the cam follower pin guide wherein the edges of the first and second barrel cams form a flattened section, i.e., a cam flat. This is illustrated within FIGS. 7 and 11 which shows the piston (5) at or near bottom dead center in its fully retracted position. At this point, when both the inlet and outlet ports are closed, the motor shaft may rotate the coupler (7) and piston (5) for several degrees without the piston retracting any further or beginning its extension within the cylinder (3). Again, the piston simply continues to rotate at this second point of rotational dwell without any reciprocating motion. As mentioned above, the rotational dwell of the first and second barrel cam halves creates a linear dwell in the reciprocating movement of the piston and thus in the reopening of a port. This eliminates pressure build up and consequential fluid pulses when the inlet and outlet ports are opened.

In summary, there is a relationship between the barrel cam flats and the opening and closing of the inlet and outlet ports in the cylinder. In known metering pumps, the rotational motion of the cam follower pin is always concurrently transitioning the piston to linear motion. The pin in such devices is essentially in a constant elliptical orbit. Consequently, there is always linear motion with any rotational motion. The drawback of this is the condition is that unwanted pressures build when both the inlet and outlet ports are rotationally closed at the extreme ends of the orbit of the pin. These pressures are unwanted because it creates fluid pulses when the inlet port and outlet port starts to reopen. A barrel cam with flats eliminates this condition. Known metering pumps cannot be modified to eliminate the build up of pressure due to the elliptical orbit of the cam follower pin. In the present device, an amount of linear dwell may be provided to ensure that the piston has rotated enough to partially open a port prior to any linear transition of the piston, thus eliminating a fluid pulse. The required amount of dwell is application specific and is determined by the characteristics of the fluid, including but not limited to, gas content, temperature, viscosity, as well as the size of the pump cylinder, motor speed, etc.

However, in alternative embodiments, it may be desirable to have a fluid pulse at one end of the piston stroke and no fluid pulse at the other end of the piston stroke. In such embodiments, the first and second barrel cams may be designed to allow the cam follower pin to travel along an elliptical slot or cam follower pin guide at one end (resulting in a pulse) and a dwell at an opposing end (resulting in no pulse) to achieve this objective.

As further mentioned above, the piston (5) includes a leading barrel hoop (23) present at the leading end of the piston (5) and a trailing bearing surface (24) at the trailing end of the piston (5) as shown in FIG. 12. The leading barrel hoop (23) forms an arc at the leading end of the piston (5) allowing the piston (5) to have a circular end at the leading end of the piston (5) while the trailing bearing surface (24) also forms an arc at the trailing end of the piston. The arc formed at the leading end of the piston (5) and the trailing end of the piston (5) by the leading barrel hoop (23) and the trailing bearing surface (24) allows the piston (5) to have a circular and cylindrical shape at the leading and trailing ends of the cylinder (5), thereby allowing the piston (5) to form a bearing within the cylinder (3). This feature provides additional stability to the fitting of the piston (5) within the cylinder (3) and a more precise fit of the piston (5) within the cylinder (3) as the bearing surfaces at the leading and trailing end of the piston allows the piston to travel in a more precise manner relative to the cylinder. This feature further allows the reciprocal and rotational motion of piston (5) within the cylinder (3) to travel in a more restricted and precise manner without deviating from the desired reciprocal and rotational motions. Thus, relative motion of the piston (5) within the cylinder is constrained to only the desired motion, i.e., reciprocal and rotational motion. Positioned in between the leading bearing hoop (29) and the trailing bearing surface and between a first and second piston shut off edge (21) is the D-shaped cutout (38) within the piston (5). Positioned below the "D" shaped cutout (38) is an internal cutout (40) within the body of the piston (5). The internal cutout (40) may also be referred to as a fluid passageway cutout, a fluid passageway, a fluid passage or fluid passage cutout. The fluid passageway cutout (40) includes a first opening (25) at the leading end of the cylinder (5) which leads to the fluid passageway (40) that extends into the body of the piston, and a second opening (39) at a planar surface forming a back side of the "D" shaped cutout (38) (Note: the front side of the "D" shaped cutout is formed from the profile of the cutout extending from the surface to a distance within the body of the cylinder which is in the shape of an arc resembling the arc of the letter "D"). The second opening (39) at the planar surface forming a back side of the "D" shaped cutout (38) forms a portion of the internal cutout positioned below the D-shaped cutout. The first and second openings (25) and (39) of the fluid passageway cutout (40) allows fluid to travel from the inlet port (19) through and passed the cylinder to a space between the leading end of the piston (5) and the inside face at the leading end of the cylinder (3) and from the space between the leading end of the piston (5) and the inside face at the leading end of the cylinder through and passed the cylinder to the outlet port (20).

Fluid flow rate through the metering pump and precision of volumetric flow through the metering pump are controlled by the volumetric displacement of the piston and the motor speed. The volumetric displacement of the piston is scalable by the diameter of the piston and the stroke distance. Metering flow rate of any size rotating reciprocating piston pump directly correlates with the motor speed. Current motor control technology provides motors that precisely rotate at a specific speed, motors characterized as infinitely variable speed motors and motors that have stepper motions that rotate a specific number of degrees. These different motor technologies can be configured for use with the rotating reciprocating piston pump to provide the desired fluid flow rate and volumetric flow.

The rotating reciprocating piston pump (RRP) disclosed herein provides the following distinctions over known devices. The piston of the rotating reciprocating piston pump disclosed herein may be characterized by three features: 1) a pumping section, which includes the D shaped cross-section; 2) guiding surface(s) at opposite ends of the D shaped cross-section, which guide the piston through the cylinder of the pump head; and 3) a coupling end, which connects the piston to the motor shaft which transmits rotational motion to the piston. The rotating reciprocating piston pump does not have independent valves. Rather, it uses a rotating piston to open and close ports on the side of the pump housing. In order to prevent leakage between the wall of the cylinder and the piston, the piston and cylinder require precise tolerances provided by the guiding surfaces which contribute to the pumping function of the piston.

The following Key is provided with reference to FIGS. 13A through 13D.

Figure 13A:
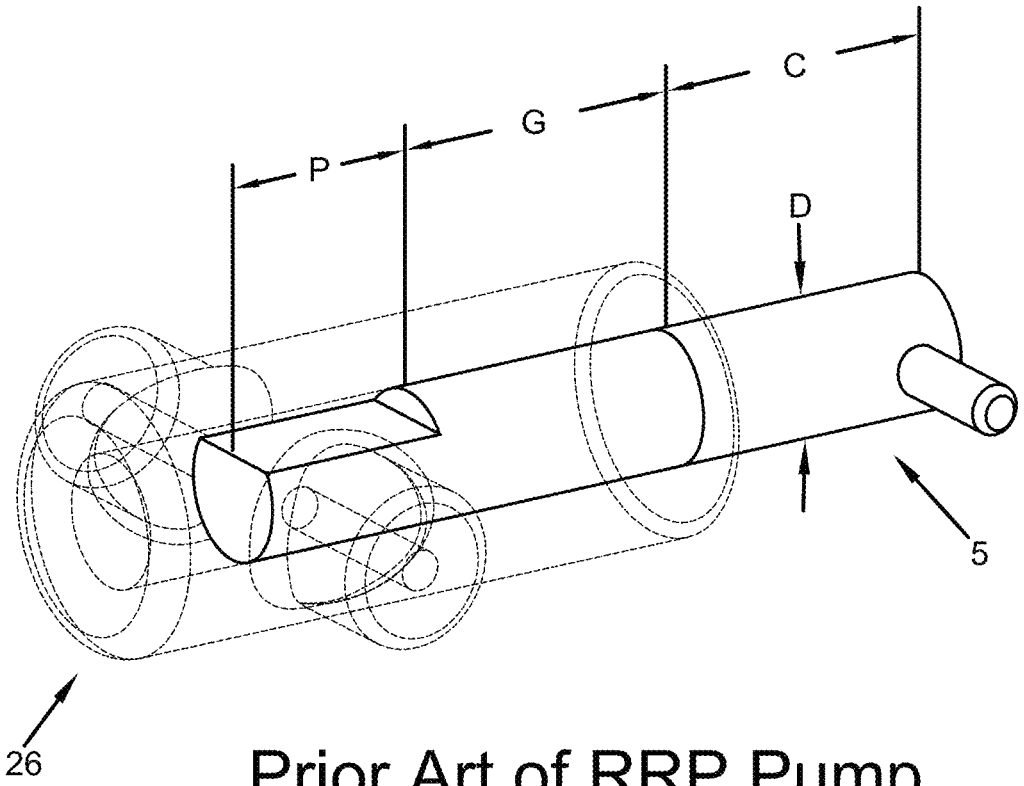
FIG. 13A is a perspective side view of rotating reciprocating piston pump of the prior art showing the piston at its fully retracted position from the pump head at the inlet stroke.
Figure 13B:
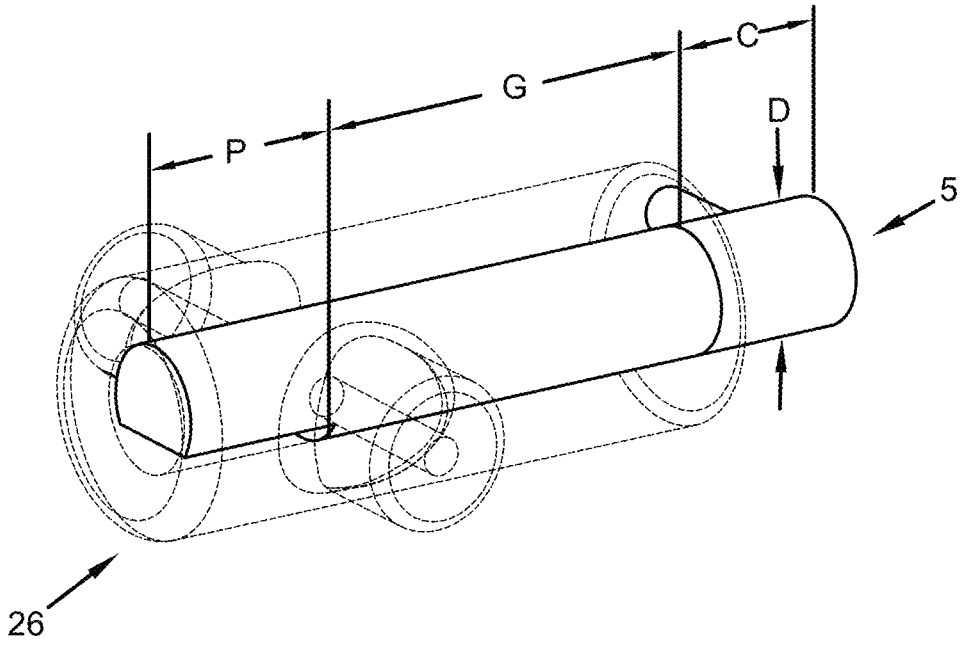
FIG. 13B is a perspective side view of rotating reciprocating piston pump of the prior art showing the piston at its fully extended position toward the pump head at the outlet stroke.
Figure 13C:
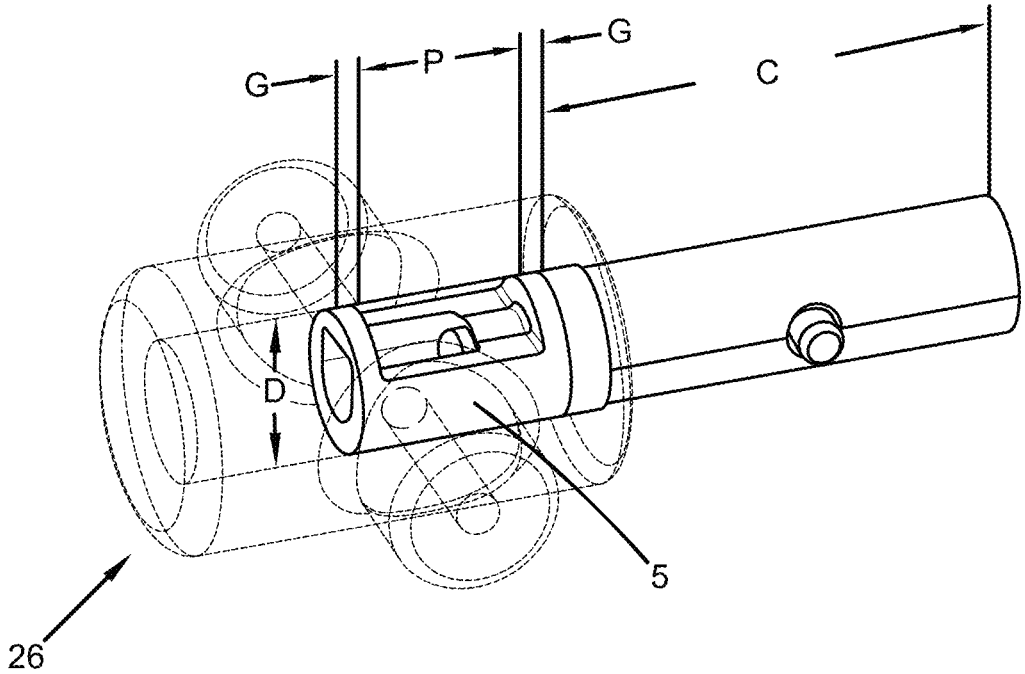
FIG. 13C is a perspective side view of rotating reciprocating piston pump of the pump described herein showing the piston at its fully retracted position from the pump head at the inlet stroke.
Figure 13D:
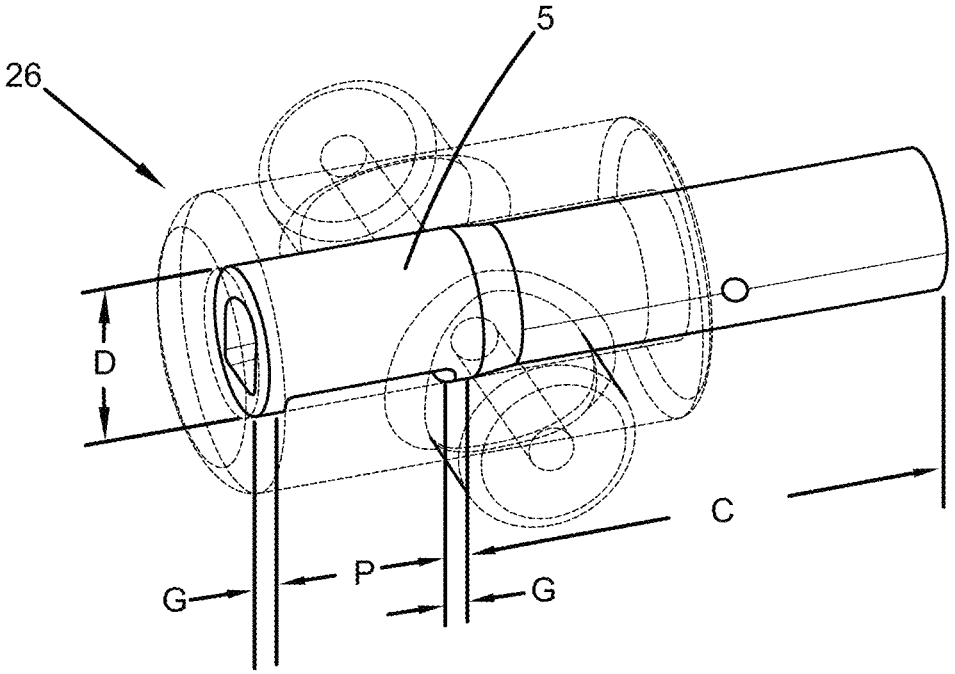
FIG. 13D is a perspective side view of rotating reciprocating piston pump of the pump described herein showing the piston at its fully extended position toward the pump head at the outlet stroke.

P=Pumping section of the piston
G=Guiding surface(s) of the piston
C=Coupling section of the piston
D=Diameter of the piston Known rotating reciprocating piston pumps include a piston having a single elongated guiding surface section. This is shown in FIGS. 13A and 13B with FIG. 13A illustrating the piston (5) at full retraction from the pump head (26) at the inlet stroke and FIG. 13B showing the piston (5) at full extension toward the pump head (26) at the outlet stroke. Typically, the length of the guiding surface section of these devices is two to three times the diameter of the piston (5). In these known devices, the entire guiding surface is positioned between the motor coupling end of the piston (5) and the pumping end of the piston. In essence, the pumping section of the piston (5) is cantilevered from the guiding surface. In the present device disclosed herein, the piston has two guiding surfaces—one guiding surface at each opposing end of the pumping section (i.e., the D shaped cross section). This is shown in FIGS. 13C and 13C with FIG. 13C illustrating the piston (5) at full retraction from the pump head (26) at the inlet stroke and FIG. 13D showing the piston (5) at full extension toward the pump head (26) at the outlet stroke. In this configuration, the pumping section is not cantilevered. Consequently, the two guiding surfaces work in unison to guide the piston through the cylinder housing. This arrangement provides a more effective guidance than the cantilevered arrangement of known devices because the separation between the two guiding surfaces keeps the piston's pumping section more ideally aligned with the cylinder housing. This allows the total length of the two guiding surfaces to be significantly shorter than that of the cantilevered piston's guiding surfaces. For example, the sum of the length of the two guiding surfaces may be less than one-half of the piston's diameter, effectively reducing the length of the piston by two to two and one-half times. The mating cylinder within the pump head may also be shortened with respect to the piston head. It is noted that according to certain aspects of the present teaching, the cylinder housing may be fabricated to be a one-piece design with a pump head or it may comprise a separate cylinder component within a pump head.

According to Clause 1, provided is a metering pump assembly including: a motor, wherein the motor comprises a motor shaft positioned along an axis which moves in a rotational manner when energized by the motor; a pump housing, wherein the pump housing comprises a trailing end and a closed leading end; a piston positioned within the pump housing, wherein the piston comprises a trailing end and a leading end, wherein the trailing end of the piston is connected to the motor shaft and the motor along the axis of the motor shaft, wherein a space is provided between the leading end of the piston and the closed leading end of the pump housing, wherein the space fluctuates in size depending on the position of the piston within the pump housing; an inlet port, wherein the inlet port extends through the pump housing; an outlet port, wherein the outlet port extends through the pump housing; a first barrel cam half; a second barrel cam half; a cam follower pin, wherein the cam follower pin is positioned within a peripheral slot between the first barrel cam half and the second barrel cam half, wherein the first barrel cam half and the second barrel cam half are connected to the piston, wherein rotational movement of the motor shaft directly imparts rotational movement upon the piston and indirectly imparts reciprocal movement of the piston through movement of the cam follower pin within the peripheral slot between the first barrel cam half and the second barrel cam half, and wherein the piston remains aligned with the axis of the motor shaft during rotational and reciprocal movement of the piston without having to angle the piston with respect to the motor shaft to generate reciprocal movement of the piston within the pump housing.

According to Clause 2, the metering pump assembly of Clause 1 is provided, wherein the piston is connected to the motor shaft of the motor through a coupler.

According to Clause 3, the metering pump assembly of Clause 1 or Clause 2 is provided, wherein the cam follower pin extends outward from the coupler.

According to Clause 4, the metering pump assembly of any of Clauses 1 to 3 is provided, wherein the first barrel cam half and the second barrel cam half are positioned over the coupler, wherein the first barrel cam half is positioned over a trailing end of the coupler and the second barrel cam half is positioned over a leading end of the coupler.

According to Clause 5, the metering pump assembly of any of Clauses 1 to 4 is provided, wherein the first barrel cam half and the second barrel cam half includes a first angled cam edge, a second angled cam edge on a side opposing the first angled cam edge, a first barrel cam flat and a second barrel cam flat.

According to Clause 6, the metering pump assembly of any of Clauses 1 to 5 is provided, wherein the pump housing includes a cylindrical housing and wherein the piston includes a body having a cylindrical surface, a trailing end and a leading end, wherein the cylindrical surface of the body of the piston includes a "D" Shaped cutout.

According to Clause 7, the metering pump assembly of any of Clauses 1 to 6 is provided, wherein the piston includes an internal cutout within the body of the piston.

According to Clause 8, the metering pump assembly of any of Clauses 1 to 7 is provided, wherein the leading end of the piston includes a leading bearing hoop positioned at the leading end of the piston and a trailing bearing surface positioned at the trailing end of the piston within the cylindrical housing, wherein the leading bearing hoop includes an opening providing access to the internal cutout within the body of the piston.

According to Clause 9, the metering pump assembly of any of Clauses 1 to 8 is provided, wherein the "D" Shaped cutout includes an opening providing access to an internal piston cavity provided by the internal cutout within the body of the piston.

According to Clause 10, the metering pump assembly of any of Clauses 1 to 9 is provided, wherein the "D" Shaped cutout within the cylindrical surface of the body of the piston includes an opening, a first piston shut off edge and a second piston shut-off edge.

According to Clause 11, the metering pump assembly of any of Clauses 1 to 10 is provided, wherein the piston is positioned in a first position and wherein the D-shaped cutout is oriented in a first position within the cylindrical housing closing access to the inlet port and to the outlet port.

According to Clause 12, the metering pump assembly of any of Clauses 1 to 11 is provided, wherein the piston is positioned in a subsequent position and wherein the "D" Shaped cutout is oriented in a second position within the cylindrical housing closing opening access to the inlet port and to the outlet port.

According to Clause 13, the metering pump assembly of any of Clauses 1 to 12 is provided, wherein movement of the piston to a subsequent position by the motor shaft causes the piston rotate and move toward the trailing end of the cylindrical housing, thereby allowing the first piston shut off edge to pass over the outlet port to close access to the outlet port, preventing fluid from entering the outlet port, and allowing the fluid to pass from the internal piston cavity through the opening in the leading bearing hoop and into the space provided between the leading end of the piston and the closed leading end of the cylindrical housing.

According to Clause 14, the metering pump assembly of any of Clauses 1 to 13 is provided, wherein movement of the piston to a subsequent position by the motor shaft causes the piston rotate and move toward the leading end of the cylindrical housing, thereby allowing the first piston shut off edge to pass over the outlet port to open access to the outlet port, allowing fluid to pass from the space provided between the leading end of the piston and the closed leading end of the cylindrical housing, enter the opening in the leading bearing hoop into the internal piston cavity provided by the internal cutout within the body of the piston, exit the internal piston cavity through the opening in the D-shaped cutout and exit the outlet port.

According to Clause 15, the metering pump assembly of any of Clauses 1 to 14 is provided, wherein the first barrel cam flat and the second barrel cam flat of the first barrel cam half and the second barrel cam half are positioned orthogonal with respect to the rotational axis of the cam in positions that are above and below the rotating coupler.

According to Clause 16, the metering pump assembly of any of Clauses 1 to 15 is provided, wherein the cam follower pin upon entering an area defined by the first barrel cam flat of the first barrel cam half and the first barrel cam flat of the second barrel cam half or the second barrel cam flat of the first barrel cam half and the second barrel cam flat of the second barrel cam half within the peripheral slot between the first barrel cam half and the second barrel cam half reaches a dwell point wherein both the inlet and out let ports are closed and wherein the motor shaft may rotate the piston without the piston moving in a reciprocating manner within the pump housing.

According to Clause 17, the metering pump assembly of any of Clauses 1 to 16 is provided, wherein the rotational dwell rotates the piston to a specific angle based on a length of the first barrel cam flat of the first barrel cam half and a length of the first barrel cam flat of the second barrel cam half or a length of the second barrel cam flat of the first barrel cam half and a length of the second barrel cam flat of the second barrel cam flat. Alternatively, according to Clause 17, the metering pump assembly of any of Clauses 1 to 16 is provided wherein the rotational dwell lasts for a period of time based on a length of the first barrel cam flat of the first barrel cam half and a length of time of the first barrel cam flat of the second barrel cam half or a length of the second barrel cam flat of the first barrel cam half and a length of the second barrel cam flat of the second barrel cam flat.

According to Clause 18, the metering pump assembly of any of Clauses 1 to 17 is provided, wherein the metering pump assembly includes a piston seal positioned between the piston and the coupler.

According to Clause 19, provided is a method of manufacturing a metering pump assembly of any of Clauses 1 to 18, including:

providing the motor;

providing the motor shaft and connecting the motor shaft to the motor, wherein the motor is capable of energizing the motor shaft to impart rotational movement upon the motor shaft;

providing the pump housing and engaging the pump housing to the motor and motor shaft, wherein the inlet port and outlet port and integrated within the pump housing;

providing the piston and positioning the piston within the pump housing;

providing the first barrel cam half and the second barrel cam half and installing the first barrel cam half and the second barrel cam half to an engagement position with respect to the piston;

providing the cam follower pin and installing the cam follower pin within the peripheral slot between the first barrel cam half and the second barrel cam half.

According to Clause 20, provided is a method of operating a metering pump assembly of any one of Clauses 1 to 19 including:

positioning the piston in the first position wherein the "D" Shaped cutout is oriented in a position corresponding to the first position of the piston within the cylindrical housing, wherein access to the inlet port and to the outlet port is closed;

positioning the piston in a second position, wherein the second position is obtained by the motor shaft causing the piston to rotate and move toward the trailing end of the pump housing, thereby allowing the first piston shut off edge to pass over the inlet port to open access to the inlet port, allowing the fluid to enter the inlet port, pass through the opening in the "D" Shaped cutout and enter the internal piston cavity provided by the internal cutout within the body of the piston and allowing the fluid to pass from the internal piston cavity through the opening in the leading bearing hoop and into the space provided between the leading end of the piston and the closed leading end of the cylindrical housing;

positioning the piston in the third position, wherein the third position is obtained by the motor shaft causing the piston to rotate and move toward the trailing end of the cylindrical housing, wherein the "D" Shaped cutout within the piston is oriented in a position corresponding to the third position of the piston within the cylindrical housing, wherein access to the inlet port and to the outlet port within a pump housing is closed wherein the fluid passes through the opening in the leading bearing hoop into the internal piston cavity provided by the internal cutout within the body of the piston;

positioning the piston in the fourth position, wherein the "D" Shaped cutout is oriented in a position corresponding to the fourth position of the piston within the cylindrical housing, wherein access to the inlet port is closed and access to the outlet port is open.

FIGURES KEY

1 Pump Housing I
2 Pump Housing II
3 Pump Cylinder
4 First Barrel Cam Half
5 Piston
6 Piston Seal
7 Coupler
8 Cam Follower Pin
9 Motor
10 Mounting Plate
11 Cylinder Port Hole
12 Inlet Port Fitting
13 Outlet Port Fitting
14 Port Seal
15 O-Ring
16 O-Ring Cap
17 Screw
18 Motor Shaft
19 Inlet Port
20 Outlet Port
21 Piston Shut-off Edge
22 General Cam Flat of First Barrel Cam Half
23 Leading Bearing Hoop
24 Trailing Bearing Surface
25 Opening at Leading End of Cylinder
26 Pump Head
27 Second Barrel Cam Half
28 General Cam Flat of Second Barrel Cam Half
29 Leading Bearing Hoop
30 First Barrel Cam Half First Angled Cam Edge
31 First Barrel Cam Half Second Angled Cam Edge
32 First Barrel Cam Half First Cam Flat
33 First Barrel Cam Half Second Cam Flat
34 Second Barrel Cam Half First Angled Cam Edge
35 Second Barrel Cam Half Second Angled Cam Edge

36 Second Barrel Cam Half First Cam Flat
37 Second Barrel Cam Half Second Cam Flat
38 D-shaped Cutout
39 Opening Forming an Internal Cutout Positioned Below the D-shaped Cutout
40 Internal Cutout While the pump and pump assembly provided herein has been described in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the pump and pump assembly should not be limited to any single embodiment, but rather, construed in breadth and scope in accordance with the recitations of the appended claims.

What is claimed is:

1. A metering pump assembly comprising:

a motor, wherein the motor comprises a motor shaft positioned along an axis aligned with the motor shaft, wherein the motor shaft moves in a rotational manner along an axis of the motor shaft when energized by the motor;

a pump housing, wherein the pump housing comprises a trailing end and a closed leading end;

a piston positioned within the pump housing, wherein the piston comprises a trailing end and a leading end, wherein the trailing end of the piston is connected to the motor shaft and the motor along the axis of the motor shaft, wherein a space is provided between the leading end of the piston and the closed leading end of the pump housing, wherein the space fluctuates in size depending on a position of the piston within the pump housing;

an inlet port, wherein the inlet port extends through the pump housing;

an outlet port, wherein the outlet port extends through the pump housing;

a first barrel cam half, wherein the first barrel cam half comprises a first barrel cam half first angled cam edge, a first barrel cam half second angled cam edge on a side opposing the first barrel cam half first angled cam edge, wherein the first barrel cam half first angled cam edge and the first barrel cam half second angled cam edge converge to form a first barrel cam half first cam flat on a first barrel cam half trailing end and wherein the first barrel cam half first angled cam edge and the first barrel cam half second angled cam edge converge to form a first barrel cam half second cam flat on a first barrel cam half leading end, wherein the first barrel cam flat first cam flat and the first barrel cam flat second cam flat are positioned to face a first same direction;

a second barrel cam half, wherein the second barrel cam half comprises a second barrel cam half first angled cam edge, a second barrel cam half second angled cam edge on a side opposing the second barrel cam half first angled cam edge, wherein the second barrel cam half first angled cam edge and the second barrel cam half second angled cam edge converge to form a second barrel cam half first cam flat on a second barrel cam half trailing end and wherein the second barrel cam half first angled cam edge and the second barrel cam half second angled cam edge converge to form a second barrel cam half second cam flat on a second barrel cam half leading end, wherein the second barrel cam flat first cam flat and the second barrel cam flat second cam flat are positioned to face a second same direction;

a cam follower pin, wherein the cam follower pin is positioned within a peripheral slot between the first barrel cam half and the second barrel cam half, wherein the first barrel cam half and the second barrel cam half circumscribe the piston, wherein rotational movement of the motor shaft imparts rotational movement upon the piston and indirectly imparts reciprocal movement of the piston through movement of the cam follower pin within the peripheral slot between the first barrel cam half and the second barrel cam half, and wherein the piston remains aligned with the axis of the motor shaft during rotational and reciprocal movement of the piston without having to angle the piston with respect to the motor shaft to generate reciprocal movement of the piston within the pump housing.

2. The metering pump assembly of claim 1, wherein the piston is connected to the motor shaft of the motor through a coupler.

3. The metering pump assembly of claim 2, wherein the metering pump assembly comprises a piston seal positioned between the piston and the coupler.

4. The metering pump assembly of claim 2, wherein the cam follower pin extends outward from the coupler.

5. The metering pump assembly of claim 4, wherein the first barrel cam half and the second barrel cam half are positioned over the coupler, wherein the first barrel cam half is positioned over a trailing end of the coupler and the second barrel cam half is positioned over a leading end of the coupler.

6. The metering pump assembly of claim 5, wherein the piston comprises a body having a cylindrical surface, and wherein the cylindrical surface of the body of the piston comprises a "D" Shaped cutout.

7. The metering pump assembly of claim 6, wherein a portion of the "D" Shaped cutout within the body of the piston comprises an opening forming an internal cutout positioned below the "D" Shaped cutout within the body of the piston, wherein the internal cutout forms an internal piston cavity and wherein the opening provides access to the internal piston cavity within the body of the piston.

8. The metering pump assembly of claim 7, wherein the leading end of the piston comprises a leading bearing hoop positioned at the leading end of the piston and a trailing bearing surface positioned at the trailing end of the piston within the pump housing, wherein the leading bearing hoop comprises an opening providing access to the internal cutout within the body of the piston.

9. The metering pump assembly of claim 8, wherein the "D" Shaped cutout within the cylindrical surface of the body of the piston comprises a first piston shut off edge and a second piston shut-off edge.

10. The metering pump assembly of claim 9, wherein the piston is positioned in a first position and wherein the "D" Shaped cutout is oriented in a first position within the pump housing closing access to the inlet port and to the outlet port.

11. The metering pump assembly of claim 9, wherein the piston is positioned in a second position and wherein the "D" Shaped cutout is oriented in a second position within the pump housing opening access to the inlet port.

12. The metering pump assembly of claim 9, wherein movement of the piston to a third position by the motor shaft causes the piston to rotate and move toward the trailing end of the pump housing, wherein the "D" Shaped cutout within the piston is oriented in a third position corresponding to the third position of the piston within the cylindrical housing, wherein access to the inlet port and to the outlet port within the pump housing is closed wherein the fluid passes through the opening in the leading bearing hoop and into the internal piston cavity provided by the internal cutout within the body of the piston.

13. The metering pump assembly of claim 9, wherein movement of the piston to a fourth position by the motor shaft causes the piston to rotate and move toward the closed leading end of the pump housing, thereby allowing the first piston shut off edge to pass over the outlet port to open access to the outlet port, allowing fluid to pass from the space provided between the leading end of the piston and the closed leading end of the pump housing, enter the opening in the leading bearing hoop into the internal piston cavity provided by the internal cutout within the body of the piston, exit the internal piston cavity through the opening in the "D" Shaped cutout and exit the outlet port.

14. The metering pump assembly of claim 1, wherein the first cam flat and the second cam flat of the first barrel cam half and the first cam flat and the second cam flat of the second barrel cam half are positioned orthogonal with respect to the axis aligned with the motor shaft in positions that are above and below the rotating coupler.

15. The metering pump assembly of claim 14, wherein the cam follower pin upon entering an area defined by the first cam flat of the first barrel cam half and the first cam flat of the second cam half or the second cam flat of the first barrel cam half and the second cam flat of the second barrel cam half within the peripheral slot between the first barrel cam half and the second barrel cam half reaches a dwell point wherein both the inlet and outlet ports are closed and wherein the motor shaft may rotate the piston without the piston moving in a reciprocating manner within the pump housing.

16. The metering pump assembly of claim 15, wherein the dwell point allows the piston to rotate to a specific angle based on a length of the first cam flat of the first barrel cam half and a length of the first cam flat of the second barrel cam half or a length of the second cam flat of the first barrel cam half and a length of the second cam flat of the second barrel cam half.

17. A method of manufacturing the metering pump assembly of claim 1, comprising:

providing the motor;

providing the motor shaft and connecting the motor shaft to the motor;

providing the pump housing and engaging the pump housing to the motor and motor shaft, wherein the inlet port and outlet port are integrated within the pump housing;

providing the piston and positioning the piston within the pump housing;

providing the first barrel cam half and the second barrel cam half and installing the first barrel cam half and the second barrel cam half to an engagement position with respect to the piston;

providing the cam follower pin and installing the cam follower pin within the peripheral slot between the first barrel cam half and the second barrel cam half.

18. A method of operating the metering pump assembly of claim 9 comprising:

positioning the piston in a first position wherein the "D" Shaped cutout is oriented in a first position corresponding to the first position of the piston within the pump housing, wherein access to the inlet port and to the outlet port is closed;

positioning the piston in a second position, wherein the second position is obtained by the motor shaft causing the piston to rotate and move toward the trailing end of the pump housing, thereby allowing the first piston shut off edge to pass over the inlet port to open access to the inlet port, allowing the fluid to enter the inlet port, pass through the opening in the "D" Shaped cutout and enter the internal piston cavity provided by the internal cutout within the body of the piston and allowing the fluid to pass from the internal piston cavity through the opening in the leading bearing hoop and into the space provided between the leading end of the piston and the closed leading end of the pump housing;

positioning the piston in a third position, wherein the third position is obtained by the motor shaft causing the piston to rotate and move toward the trailing end of the pump housing, wherein the "D" Shaped cutout within the piston is oriented in a third position corresponding to the third position of the piston within the cylindrical housing, wherein access to the inlet port and to the outlet port within the pump housing is closed wherein the fluid passes through the opening in the leading bearing hoop into the internal piston cavity provided by the internal cutout within the body of the piston;

positioning the piston in a fourth position, wherein the "D" Shaped cutout is oriented in a position corresponding to the fourth position of the piston within the pump housing, wherein access to the inlet port is closed and access to the outlet port is open.

* * * * *